US006059565A

United States Patent [19]

Knöpfel et al.

[11] Patent Number: 6,059,565

[45] Date of Patent: May 9, 2000

[54] BURNER FOR OPERATING A HEAT GENERATOR

[75] Inventors: Hans Peter Knöpfel, Besenbüren; Thomas Ruck, Mellingen, both of Switzerland

[73] Assignee: ABB Alstom Power (Switzereland) Ltd, Baden, Switzerland

[21] Appl. No.: 09/178,578

[22] Filed: Oct. 26, 1998

[30] Foreign Application Priority Data

Oct. 31, 1997 [EP] European Pat. Off. ..... 97810818

[51] Int. Cl.[7] ..... F23D 14/62

[52] U.S. Cl. ..... 431/350; 431/354; 239/402

[58] Field of Search ..... 431/354, 350, 431/9, 182, 181, 185; 239/399, 427.3, 402, 434, 466

[56] References Cited

U.S. PATENT DOCUMENTS

| | | | |
|---|---|---|---|
| 4,932,861 | 6/1990 | Keller et al. . | |
| 5,193,995 | 3/1993 | Keller et al. . | |
| 5,340,306 | 8/1994 | Keller et al. | 431/354 |
| 5,433,596 | 7/1995 | Döbbeling et al. | 431/350 |
| 5,569,020 | 10/1996 | Griffin et al. . | |
| 5,735,687 | 4/1998 | Knöpfer et al. | 431/354 |
| 5,876,196 | 3/1999 | Knöpfel et al. | 431/354 |

FOREIGN PATENT DOCUMENTS

| | | |
|---|---|---|
| 2154941 | 4/1996 | Canada . |
| 2190805 | 6/1997 | Canada . |
| 0321809B1 | 5/1991 | European Pat. Off. . |
| 0619457A1 | 10/1994 | European Pat. Off. . |
| 0710797A2 | 5/1996 | European Pat. Off. . |
| 0780629A2 | 6/1997 | European Pat. Off. . |
| 06193816 | 7/1994 | Japan . |
| WO96/09494 | 3/1996 | WIPO . |
| WO97/17574 | 5/1997 | WIPO . |

*Primary Examiner*—Ira S. Lazarus
*Assistant Examiner*—Sara Clarke
*Attorney, Agent, or Firm*—Burns, Doane, Swecker & Mathis, L.L.P.

[57] ABSTRACT

A burner for operating a heat generator, the burner including a swirl generator for a combustion-air flow and a mechanism for injecting at least one fuel into the combustion-air flow, a mixing section arranged downstream of the swirl generator and having a number of transition passages for passing a flow formed in the swirl generator into a mixing tube arranged downstream of the transition passages. The combustion-air flow into the swirl generator flows against turbulence generators, which are located upstream of the injection of the fuel into the combustion-air flow, and the turbulence generators include individual bars set transversely to the combustion-air flow.

18 Claims, 7 Drawing Sheets

100
115
201
200
10
220
40
21
60
20
31

50
30

FIG. 4
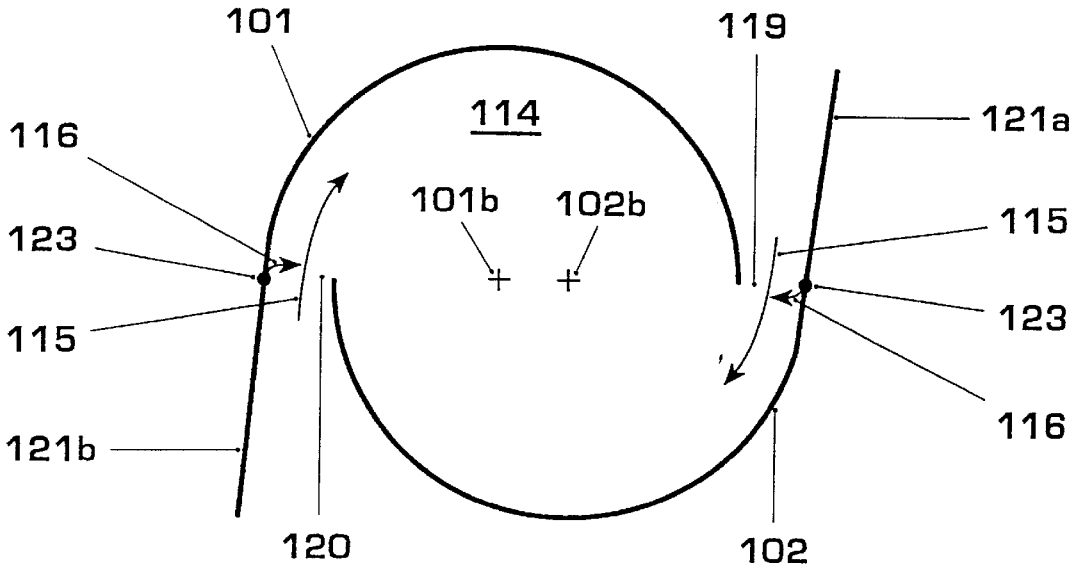
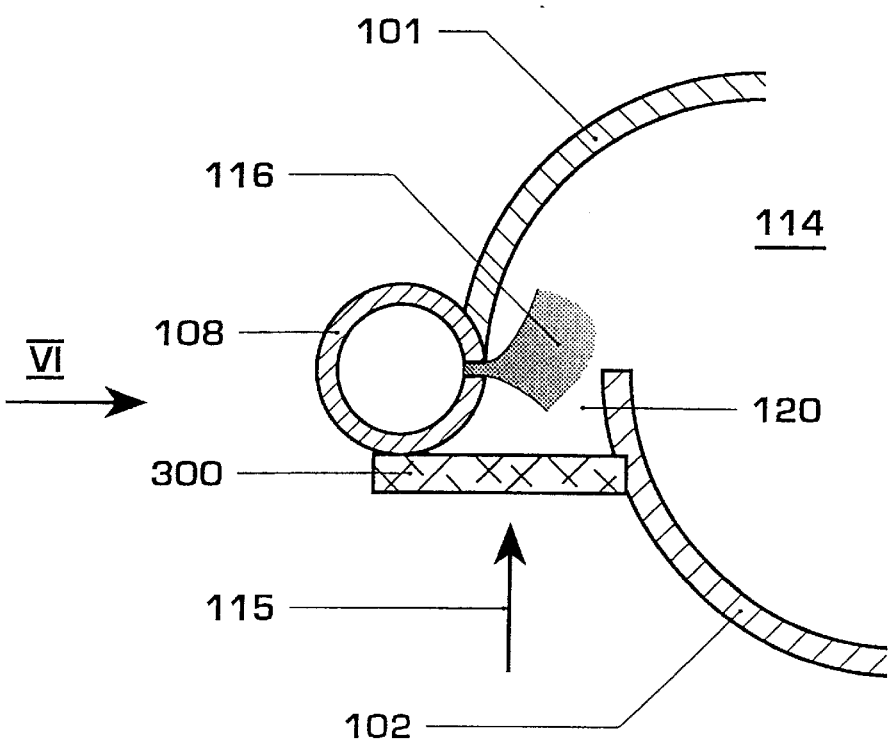
FIG. 5

BURNER FOR OPERATING A HEAT GENERATOR

BACKGROUND OF THE INVENTION

1. Field of the Invention

The present invention relates to a burner for operating a heat generator, and in particular, to a burner including a swirl generator for a combustion-air flow, means for injecting at least one fuel into the combustion-air flow, and a mixing section having a number of transition passages.

2. Discussion of Background

EP-0 780 629 A2 has disclosed a burner which consists of a swirl generator on the incident-flow side, the flow formed herein being passed over smoothly into a mixing section. This is done with the aid of a flow geometry, which is formed at the start of the mixing section for this purpose and consists of transition passages which cover sectors of the end face of the mixing section, in accordance with the number of acting sectional bodies of the swirl generator, and run helically in the direction of flow. On the outflow side of these transition passages, the mixing section has a number of prefilming bores, which ensure that the flow velocity along the tube wall is increased. This is then followed by a combustion chamber, the transition between the mixing section and the combustion chamber being formed by a jump in cross section, in the plane of which a backflow zone or backflow bubble forms. The swirl intensity in the swirl generator is therefore selected in such a way that the breakdown of the vortex does not take place inside the mixing section but further downstream, as explained above, in the region of the jump in cross section. The length of the mixing section is dimensioned in such a way that an adequate mixture quality is ensured for all types of fuel.

Although this burner, compared with those from the prior art, guarantees a significant improvement with regard to intensification of the flame stability, lower pollutant emissions, lower pulsations, complete burn-out, large operating range, good cross-ignition between the various burners, compact type of construction, improved mixing, etc., it has been found that the mixing quality of the gas/air mixture inside the swirl generator is decisive for achieving low pollutant emission values. The limited factor in the gas injection is the gas supply pressure available, which determines the depth of penetration of the gas jet into the air space and thus the intermixing.

SUMMARY OF THE INVENTION

Accordingly, one object of the invention, as defined in the claims, in a burner of the type mentioned at the beginning, is to propose novel measures which are able to improve the mixing quality of the gas/air mixture at uniform gas supply pressure.

For this purpose, the burner is extended in such a way that, upstream of the gas injectors integrated in the swirl generator, the combustion air flowing in through the air-inlet ducts is directed through turbulence generators before it reaches the region of said gas injectors. These turbulence generators can be simplified to such an extent that they are individual bars of various cross section which are at a distance from one another and are arranged transversely in the air-inlet ducts. If the bottom edges of these vortex generators are at a sufficient distance from the gas injectors, vortex trails form in this free space and enable the gas jet to be injected from said gas injectors into a zone of lower air velocity and greater turbulence.

The essential advantages of the subject matter of the invention may be seen in the fact that, due to the greater depth of penetration of the gas jet, coupled with the turbulence acting there on account of said vortex trails, the mixing quality of the gas/air mixture is substantially improved and the pollutant emissions from the combustion are markedly reduced.

The subject matter of the invention is also especially suitable in the case of other burners, in particular in the case of a burner according to publication EP-0 321 809 B1, this publication being an integral part of the present description.

Advantageous and expedient developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4 shows a cross section through a two-shell swirl generator, FIG. 5 shows a disposition of turbulence generators which act in the region of the air-inlet ducts upstream of the gas injection.

DESCRIPTION OF THE PREFERRED EMBODIMENTS

Figures 1, 10:
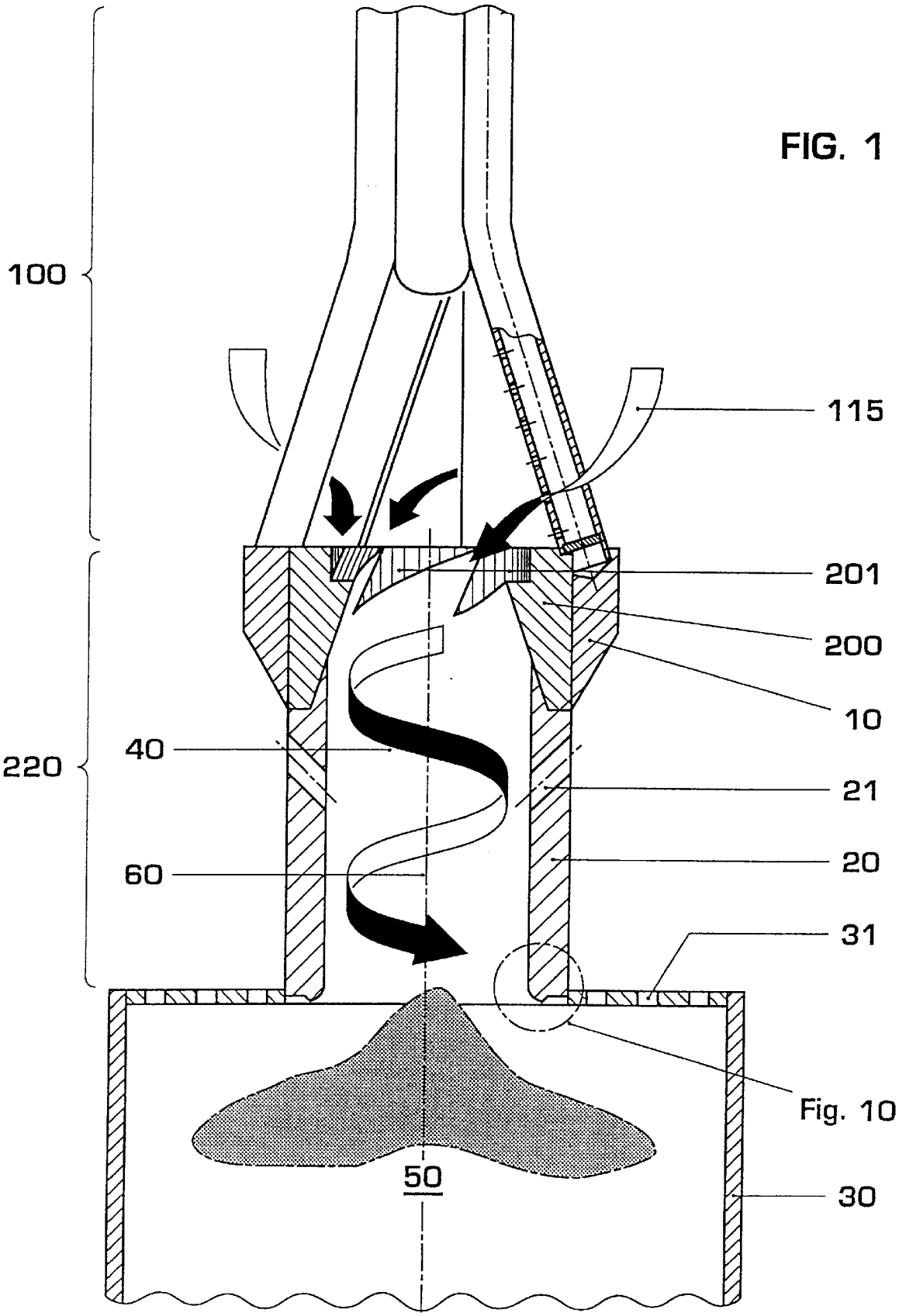
FIG. 1 shows a burner designed as a premix burner and having a mixing section downstream of a swirl generator.
FIG. 10 shows a breakaway edge for the spatial stabilization of the backflow zone.

Referring now to the drawings, wherein like reference numerals designate identical or corresponding parts throughout the several views, all features not essential for the direct understanding of the invention have been omitted, and the direction of flow of the media is indicated by arrows, FIG. 1 shows the overall construction of a burner. Initially a swirl generator 100 is effective, the configuration of which is shown and described in more detail below in FIGS. 2–8. This swirl generator 100 is a conical structure to which an entering combustion-air flow 115 is repeatedly admitted tangentially. The swirl flow forming here, with the aid of a transition geometry provided downstream of the swirl generator 100, is passed smoothly into a transition piece 200 in such a way that no separation regions can form in this zone. The configuration of this transition geometry is described in more detail under FIG. 9. This transition piece 200 is extended on the outflow side of the transition geometry by a mixing tube 20, both parts forming the actual mixing section 220. The mixing section 220 may of course be made in one piece; i.e. the transition piece 200 and mixing tube 20 are then fused to form a single cohesive structure, the characteristics of each part being retained. If transition piece 200 and mixing tube 20 are made from two parts, these parts are connected by a sleeve ring 10, the same sleeve ring 10 serving as an anchoring surface for the swirl generator 100 on the head side. In addition, such a sleeve ring 10 has the advantage that various mixing tubes can be used without having to change the basic configuration in any way. Located on the outflow side of the mixing tube 20 is the actual combustion space 30 of a combustion chamber, which is shown here merely by a flame tube. The mixing section 220 largely fulfills the task of providing a defined section, in which perfect premixing of fuels of various types can be achieved, downstream of the swirl generator 100. Furthermore, this mixing section, that is primarily the mixing tube 20, enables the flow to be directed free of losses so that at first no backflow zone or backflow bubble can form even in interaction with the transition geometry, whereby the mixing quality for all types of fuel can be influenced over the length of the mixing section 220. However, this mixing section 220 has another property, which consists in the fact that, in the mixing section 220 itself, the axial velocity profile has a pronounced maximum on the axis, so that a flashback of the flame from the combustion chamber is not possible However, it is correct to say that this axial velocity decreases toward the wall in such a configuration. In order also to prevent flashback in this region, the mixing tube 20 is provided in the flow and peripheral directions with a number of regularly or irregularly distributed bores 21 having widely differing cross sections and directions, through which an air quantity flows into the interior of the mixing tube 20 and induces an increase in the rate of flow along the wall for the purposes of a prefilmer. These bores 21 may also be designed in such a way that effusion cooling appears at least in addition at the inner wall of the mixing tube 20. Another possibility of increasing the velocity of the mixture inside the mixing tube 20 is for the cross section of flow of the mixing tube 20 on the outflow side of the transition passages 201, which form the transition geometry already mentioned, to undergo a convergence, as a result of which the entire velocity level inside the mixing tube 20 is raised. In the figure, these bores 21 run at an acute angle relative to the burner axis 60. Furthermore, the outlet of the transition passages 201 corresponds to the narrowest cross section of flow of the mixing tube 20. Said transition passages 201 accordingly bridge the respective difference in cross section without at the same time adversely affecting the flow formed. If the measure selected initiates an intolerable pressure loss when directing the tube flow 40 along the mixing tube 20, this may be remedied by a diffuser (not shown in the figure) being provided at the end of this mixing tube. A combustion chamber (combustion space 30) then adjoins the end of the mixing tube 20, there being a jump in cross section, formed by a burner front 70, between the two cross sections of flow. Not until here does a central flame front having a backflow zone 50 form, which backflow zone 50 has the properties of a bodiless flame retention baffle relative to the flame front. If a fluidic marginal zone, in which vortex separations arise due to the vacuum prevailing there, forms inside this jump in cross section during operation, this leads to intensified ring stabilization of the backflow zone 50. At the end face, the combustion space 30, provided this location is not covered by other measures, for example by pilot burners, has a number of openings 31 through which an air quantity flows directly into the jump in cross section and there, inter alia, helps to intensify the ring stabilization of the backflow zone 50. In addition, it must not be left unmentioned that the generation of a stable backflow zone 50 requires a sufficiently high swirl coefficient in a tube. If such a high swirl coefficient is undesirable at first, stable backflow zones may be generated by the feed of small, intensely swirled air flows at the tube end, for example through tangential openings. It is assumed here that the air quantity required for this is approximately 5–20% of the total air quantity. As far as the configuration of the burner front 70 at the end of the mixing tube 20 for stabilizing the backflow zone or backflow bubble 50 is concerned, reference is made to the description under FIG. 10.

Figure 2:
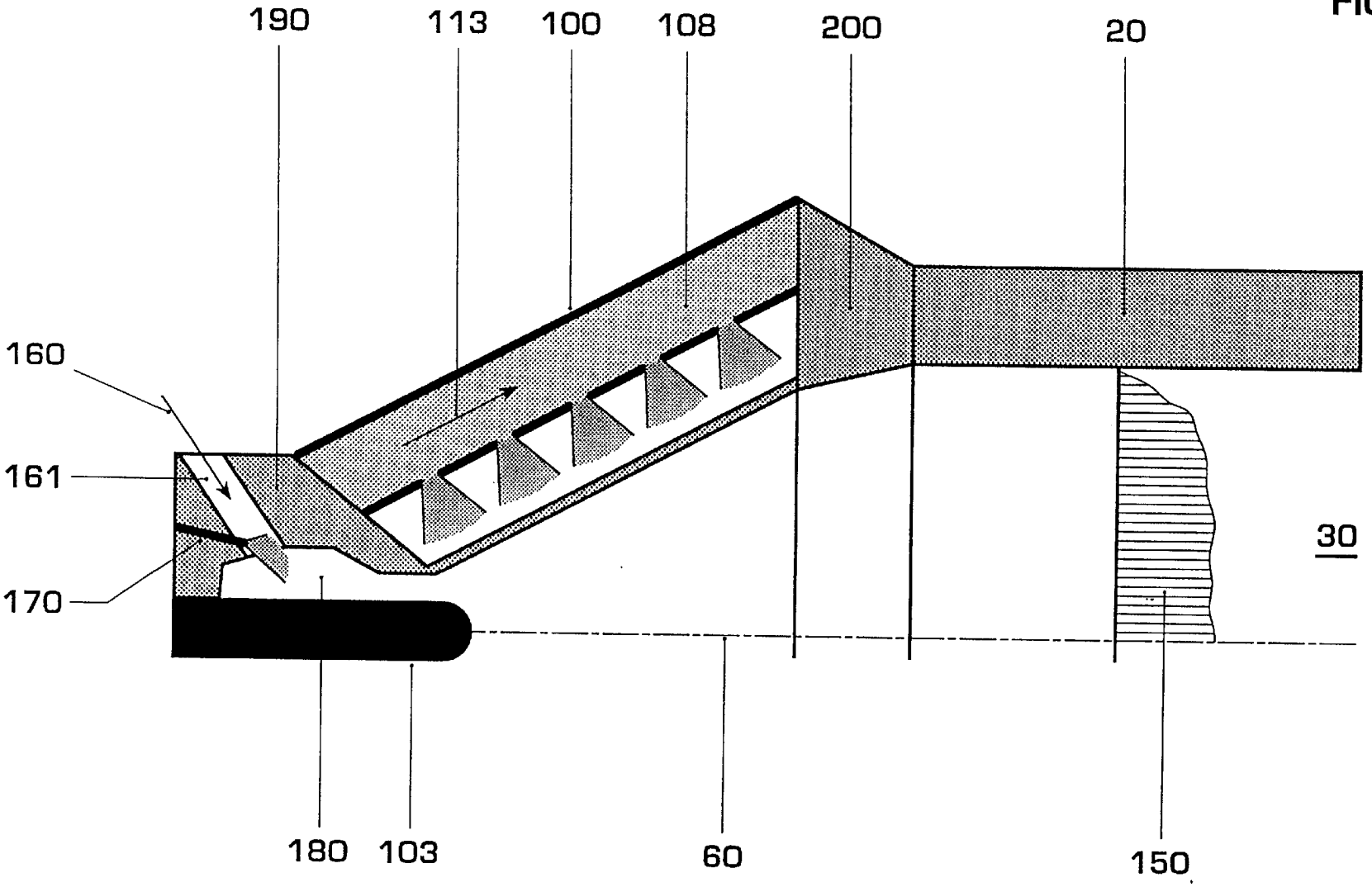
FIG. 2 shows a schematic representation of the burner according to FIG. 1 with the disposition of the additional fuel injectors.

FIG. 2 shows a schematic view of the burner according to FIG. 1, reference being made here in particular to the purging around a centrally arranged fuel nozzle 103 and to the action of fuel injectors 170. The mode of operation of the remaining main components of the burner, namely swirl generator 100 and transition piece 200, are described in more detail under the following figures. The fuel nozzle 103 is encased at a distance by a ring 190 in which a number of bores 161 disposed in peripheral direction are placed, and an air quantity 160 flows through these bores 161 into an annular chamber 180 and performs the purging there around the fuel lance. These bores 161 are positioned so as to slant forward in such a way that an appropriate axial component is obtained on the burner axis 60. Provided in interaction with these bores 161 are additional fuel injectors 170 which feed a certain quantity of preferably a gaseous fuel into the respective air quantity 160 in such a way that an even fuel concentration 150 appears in the mixing tube 20 over the cross section of flow, as the representation in the figure is intended to symbolize. It is precisely this even fuel concentration 150, in particular the pronounced concentration on the burner axis 60, which provides for stabilization of the flame front at the outlet of the burner to occur, whereby the occurrence of combustion-chamber pulsations is avoided.

Figure 3:
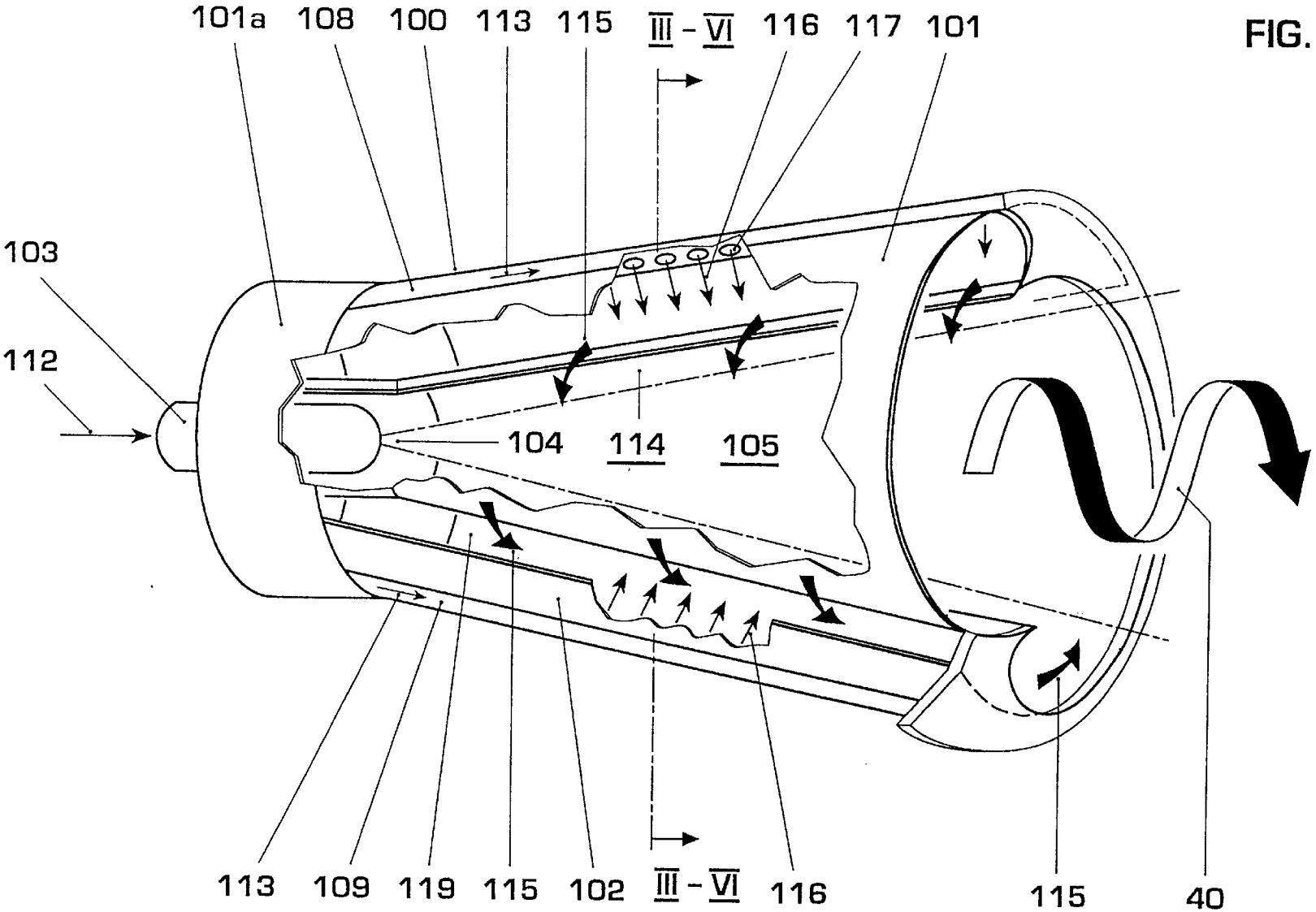
FIG. 3 shows a perspective representation of a swirl generator consisting of a plurality of shells, in appropriate cut-away section.

In order to better understand the construction of the swirl generator 100, it is of advantage if at least FIG. 4 is used at the same time as FIG. 3. In the description of FIG. 3 below, the remaining figures are referred to when required.

Figure 6:
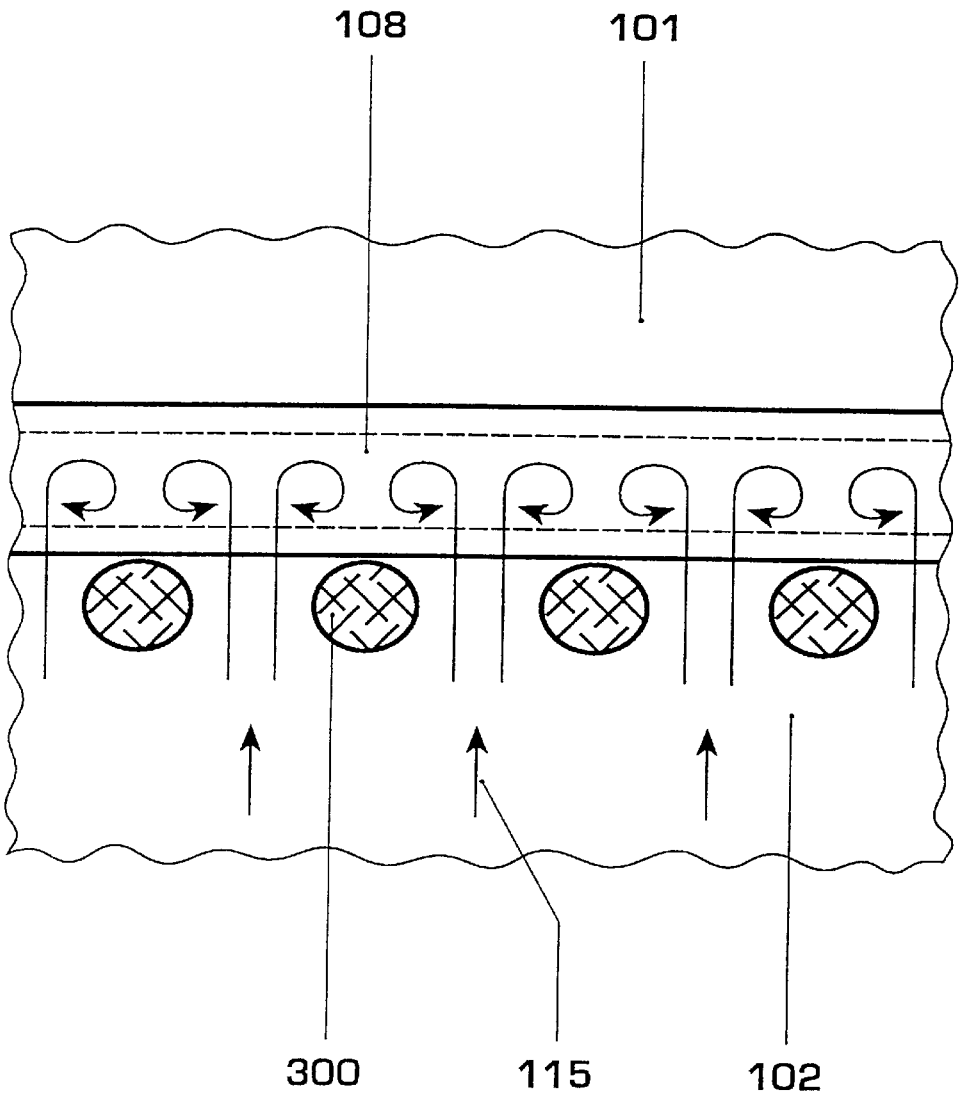
FIG. 6 shows a distribution of the turbulence generators along the air-inlet ducts.
Figure 7:
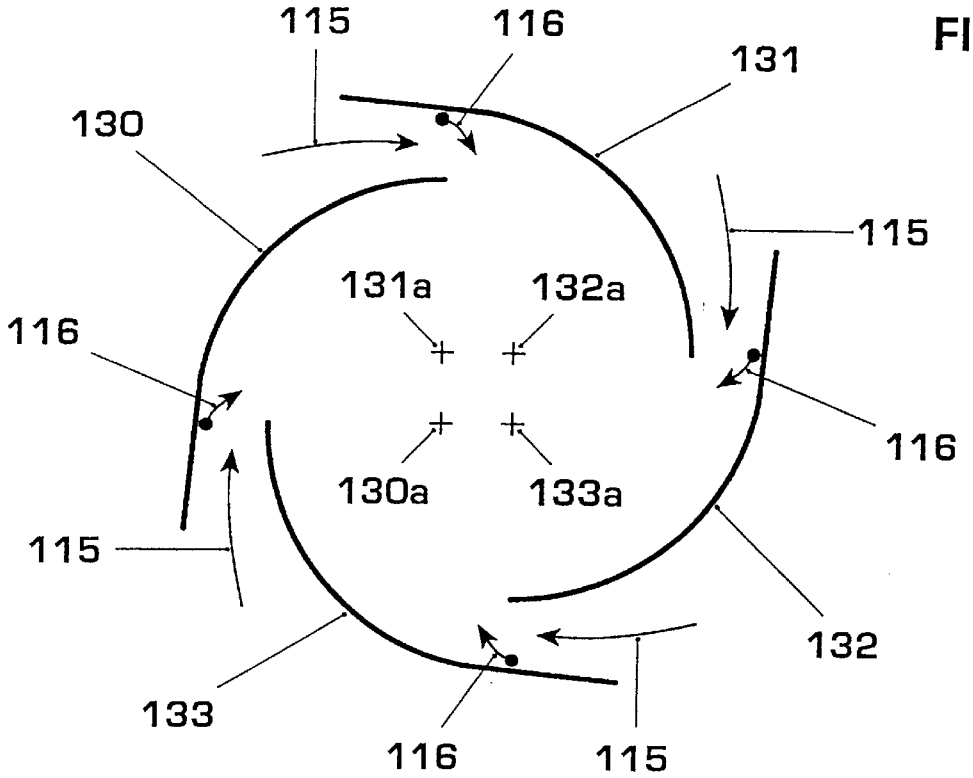
FIG. 7 shows a cross section through a four-shell swirl generator.

The first part of the burner according to FIG. 1 forms the swirl generator 100 shown according to FIG. 3. The swirl generator 100 consists of two hollow conical sectional bodies 101, 102 which are nested one inside the other in a mutually offset manner. The number of conical sectional bodies may of course be greater than two, as FIGS. 6 and 7 show; this depends in each case on the mode of operation of the entire burner, as will be explained in more detail further below. It is not out of the question in certain operating configurations to provide a swirl generator consisting of a single spiral. The mutual offset of the respective center axis or longitudinal symmetry axes 101*b*, 102*b* (cf. FIG. 4) of the conical sectional bodies 101, 102 provides at the adjacent wall, in mirror-image arrangement, one tangential duct each, i.e. an airinlet slot 119, 120 (cf. FIG. 4) through which the combustion air 115 flows into the interior space of the swirl generator 100, i.e. into the conical hollow space 114 of the same. As far as the measures in connection with this inflow of the combustion air 115 into the conical hollow space 114 are concerned, reference is made to FIGS. 5 and 6. The conical shape of the sectional bodies 101, 102 shown has a certain fixed angle in the direction of flow. Of course, depending on the operational use, the sectional bodies 101, 102 may have increasing or decreasing conicity in the direction of flow, similar to a trumpet or tulip respectively.

The two last-mentioned shapes are not shown graphically, since they can readily be visualized by a person skilled in the art. The two conical sectional bodies 101, 102 each have a cylindrical annular initial part 101*a*. Accommodated in the region of this cylindrical initial part is the fuel nozzle 103, which has already been mentioned under FIG. 2 and is preferably operated with a liquid fuel 112. The injection 104 of this fuel 112 coincides approximately with the narrowest cross section of the conical hollow space 114 formed by the conical sectional bodies 101, 102. The injection capacity of this fuel nozzle 103 and its type depend on the predetermined parameters of the respective burner. Furthermore, the conical sectional bodies 101, 102 each have a fuel line 108, 109, and these fuel lines 108, 109 are arranged along the tangential air-inlet slots 119, 120 and are provided with injection openings 117 through which preferably a gaseous fuel 113 is injected into the combustion air 115 flowing through there, as the arrows 116 are intended to symbolize. These fuel lines 108, 109 are preferably arranged at the latest at the end of the tangential inflow, before entering the conical hollow space 114, in order to obtain optimum fuel/air mixing. As mentioned, the fuel 112 fed through the fuel nozzle 103 is a liquid fuel in the normal case, a mixture formation with another medium, for example with a recycled flue gas, being readily possible. This fuel 112 is injected at a preferably very acute angle into the conical hollow space 114. Thus a conical fuel spray 105, which is enclosed and reduced by the rotating combustion air 115 flowing in tangentially, forms from the fuel nozzle 103. The concentration of the injected fuel 112 is then continuously reduced in the axial direction by the inflowing combustion air 115 to form a mixture in the direction of vaporization. If a gaseous fuel 113 is injected via the opening nozzles 117, the fuel/air mixture is formed directly at the end of the air-inlet slots 119, 120. If the combustion air 115 is additionally preheated or, for example, enriched with recycled flue gas or exhaust gas, this provides lasting assistance for the vaporization of the liquid fuel 112, before this mixture flows into the downstream stage, here into the transition piece 200 (cf. FIGS. 1 and 8). The same considerations also apply if liquid fuels are to be supplied via the lines 108, 109. Narrow limits per se are to be adhered to in the configuration of the conical sectional bodies 101, 102 with regard to the cone angle and the width of the tangential air-inlet slots 119, 120, so that the desired flow field of the combustion air 115 can develop at the outlet of the swirl generator 100. In general it may be said that a reduction in the tangential air-inlet slots 119, 120 promotes the quicker formation of a backflow zone already in the region of the swirl generator. The axial velocity inside the swirl generator 100 can be increased or stabilized by a corresponding feed of an air quantity, this feed being described in more detail under FIG. 2 (item 160). Corresponding swirl generation in interaction with the downstream transition piece 200 (cf. FIGS. 1 and 8) prevents the formation of flow separations inside the mixing tube arranged downstream of the swirl generator 100. Furthermore, the design of the swirl generator 100 is especially suitable for changing the size of the tangential air-inlet slots 119, 120, whereby a relatively large operational range can be covered without changing the overall length of the swirl generator 100. The sectional bodies 101, 102 may of course be displaced relative to one another in another plane, as a result of which even an overlap of the same can be provided. Furthermore, it is possible to nest the sectional bodies 101, 102 spirally one inside the other by a contra-rotating movement. It is thus possible to vary the shape, size and configuration of the tangential air-inlet slots 119, 120 as desired, whereby the swirl generator 100 can be used universally without changing its overall length.

Inter alia, the geometric configuration of baffle plates 121*a*, 121*b*, which may be provided as desired, is now apparent from FIG. 4. They have a flow-initiating function, in which case, in accordance with their length, they extend the respective end of the conical sectional bodies 101, 102 in the incident-flow direction relative to the combustion air 115. The ducting of the combustion air 115 into the conical hollow space 114 can be optimized by opening or closing the baffle plates 121*a*, 121*b* about a pivot 123 placed in the region of the inlet of this duct into the conical hollow space 114, and this is especially necessary if the original gap size of the tangential air-inlet slots 119, 120 is to be changed dynamically, for example in order to change the velocity of the combustion air 115. These dynamic measures may of course also be provided statically by baffle plates forming, as and when required, a fixed integral part with the conical sectional bodies 101, 102.

FIG. 5 is a detail of FIG. 4 in the region of the inflow of the combustion air 115 into the conical hollow space 114. Arranged upstream of the gas injectors 116, which are located at the transition between the air-inlet ducts 120, 121 and the conical hollow space 114, are turbulence generators 300, which provide for the generation of a turbulence on the downstream side of the same in the region of the inflowing fuel 116. This achieves the situation where, on the one hand, a greater depth of penetration of the gas jet is brought about and, on the other hand, the mixing quality of the two media - fuel 116/combustion air 115—is substantially improved by the vortex trails (cf. FIG. 6) forming on the rear side of the turbulence generators 300, a factor which has a lasting effect on the minimizing of the pollutant emissions.

FIG. 6 shows, on the one hand, the arrangement of such vortex generators 300 and, on the other hand, the vortex trails which form on the rear side and permit an optimum mixing state. The vortex generators 300 shown here are individual bars, which are arranged at a distance from one another along the air-inlet ducts (cf. FIG. 4, items 119, 120) transversely to the inflow direction of the combustion air 115. These vortex generators may of course also have another cross section, the formation of said vortex trails always constituting the final purpose of such vortex generators. The distance between the underside of the vortex generators 300 and injection of the fuel 116 must always be dimensioned in such a way that the vortex trails are optimally positioned relative to the fuel jets.

FIG. 7, in comparison with FIG. 4, shows that the swirl generator 100 is now composed of four sectional bodies 130, 131, 132, 133. The associated longitudinal symmetry axes for each sectional body are identified by the letter a. It may be said of this configuration that, on account of the smaller swirl intensity thus produced, and in interaction with a correspondingly increased slot width, it is best suited to preventing the breakdown of the vortex flow on the outflow side of the swirl generator in the mixing tube, whereby the mixing tube can best fulfill the role intended for it.

Figure 8:
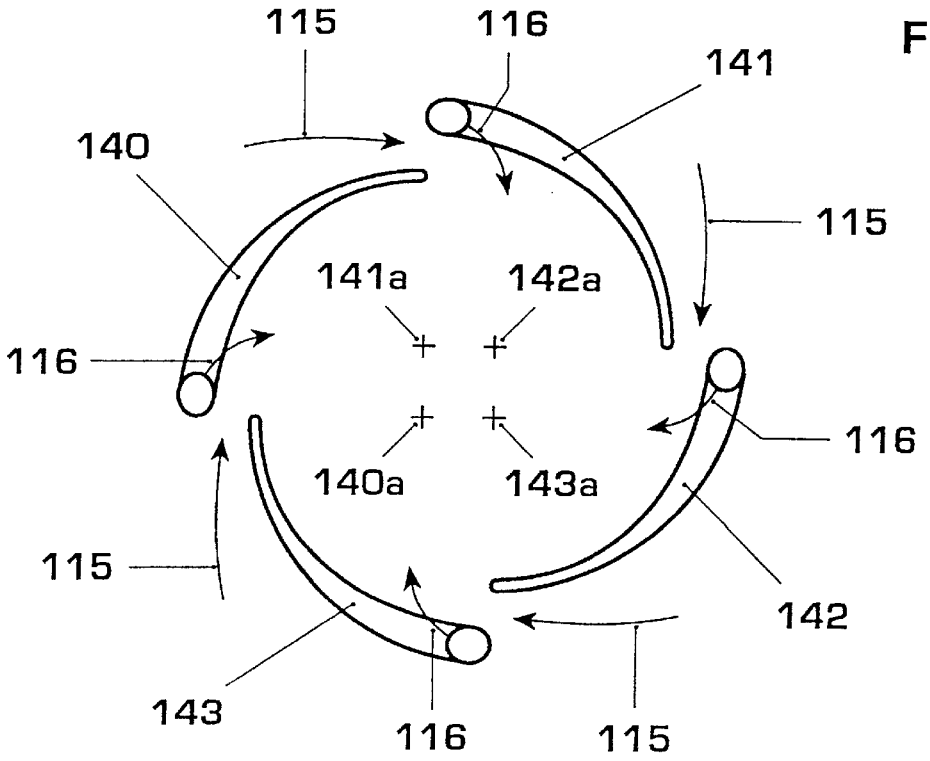
FIG. 8 shows a view through a swirl generator whose shells are profiled in a blade shape.

FIG. 8 differs from FIG. 7 inasmuch as the sectional bodies 140, 141, 142, 143 here have a blade-profile shape, which is provided for supplying a certain flow. Otherwise, the mode of operation of the swirl generator is the same. The admixing of the fuel 116 with the combustion-air flow 115 is effected from the interior of the blade profiles, i.e. the fuel line 108 is now integrated in the individual blades. Here, too, the longitudinal symmetry axes for the individual sectional bodies are identified by the letter a.

Figure 9:
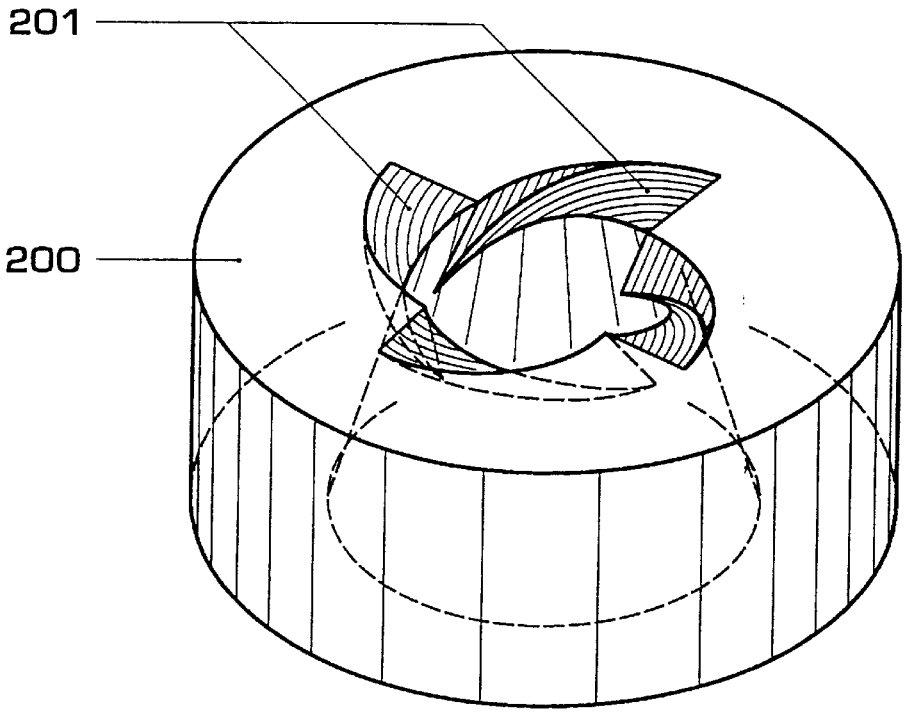
FIG. 9 shows a configuration of the transition geometry between swirl generator and mixing section.
Figure 10:
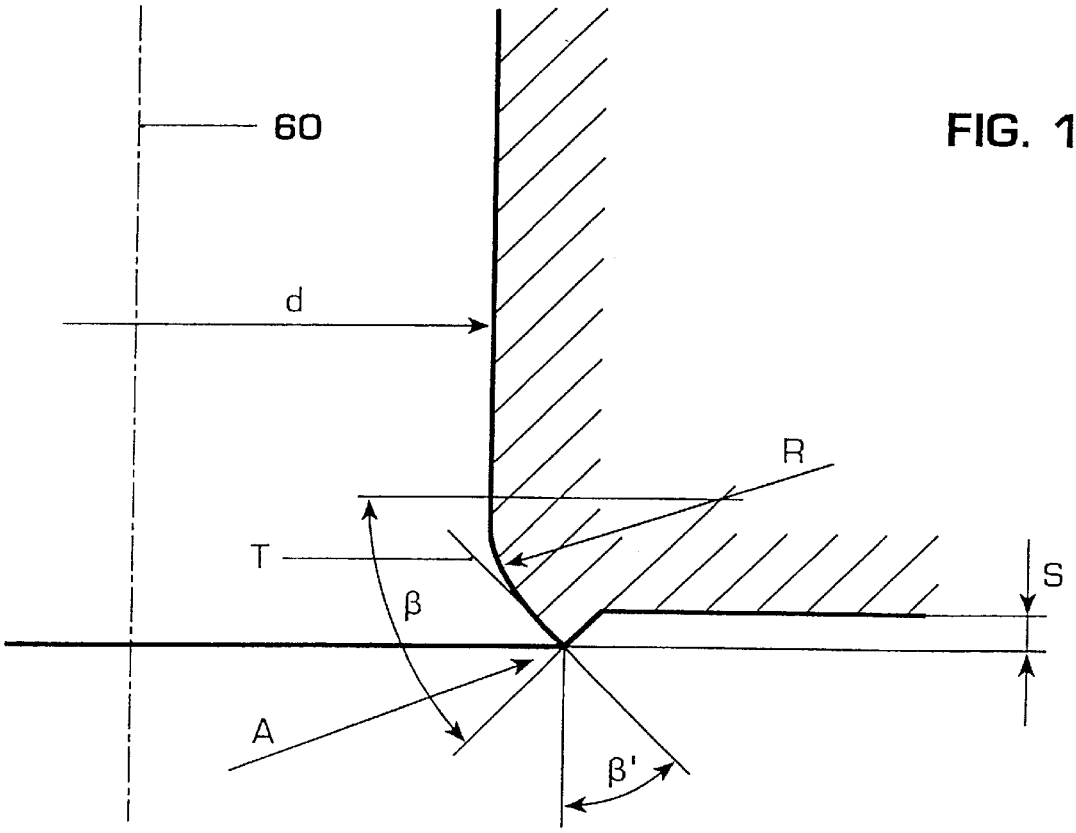

FIG. 9 shows the transition piece 200 in a three-dimensional view. The transition geometry is constructed for a swirl generator 100 having four sectional bodies in accordance with FIG. 7 or 8. Accordingly, the transition geometry has four transition passages 201 as a natural extension of the sectional bodies acting upstream, as a result of which the cone quadrant of said sectional bodies is extended until it intersects the wall of the mixing tube. The same considerations also apply when the swirl generator is constructed from a principle other than that described under FIG. 3. The surface of the individual transition passages 201 which runs downward in the direction of flow has a form which runs spirally in the direction of flow and describes a crescent-shaped path, in accordance with the fact that in the present case the cross section of flow of the transition piece 200 widens conically in the direction of flow. The swirl angle of the transition passages 201 in the direction of flow is selected in such a way that a sufficiently large section subsequently remains for the tube flow up to the jump in cross section at the combustion-chamber inlet in order to effect perfect premixing with the injected fuel. Furthermore, the axial velocity at the mixing-tube wall downstream of the swirl generator is also increased by the abovementioned measures. The transition geometry and the measures in the region of the mixing tube produce a distinct increase in the axial-velocity profile toward the center of the mixing tube, so that the risk of premature ignition is decisively counteracted.

FIG. 10 shows the breakaway edge already discussed, which is formed at the burner outlet. The cross section of flow of the tube 20 in this region is given a transition radius R, the size of which in principle depends on the flow inside the tube 20. This radius R is selected in such a way that the flow comes into contact with the wall and thus causes the swirl coefficient to increase considerably. Quantitatively, the size of the radius R can be defined in such a way that it is >10% of the inside diameter d of the tube 20. Compared with a flow without a radius, the backflow bubble 50 is now hugely enlarged. This radius R runs up to the outlet plane of the tube 20, the angle β between the start and end of the curvature being <90°. The breakaway edge A runs along one leg of the angle β into the interior of the tube 20 and thus forms a breakaway step S relative to the front point of the breakaway edge A, the depth of which is >3 mm. Of course, the edge running parallel here to the outlet plane of the tube 20 can be brought back to the outlet-plane step again by means of a curved path. The angle β' which extends between the tangent of the breakaway edge A and the perpendicular to the outlet plane of the tube 20 is the same size as angle β. The advantages of this design of this breakaway edge can be seen from EP-0 780 629 A2 under the section "SUMMARY OF THE INVENTION". A further configuration of the breakaway edge for the same purpose can be achieved with torus-like notches on the combustion-chamber side. As far as the breakaway edge is concerned, this publication, including the scope of protection there, is an integral part of the present description.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by: Letters Patent of the United States is:

1. A burner for operating a heat generator, the burner comprising:

a swirl generator for a combustion-air flow and means for injecting at least one fuel into the combustion-air flow, a mixing section arranged downstream of the swirl generator and having, inside a first part of a section in the direction of flow, a number of transition passages for passing a flow formed in the swirl generator into a mixing tube arranged downstream of the transition passages, wherein the combustion-air flow into the swirl generator flows against turbulence generators, which are located upstream of the injection of the fuel into the combustion-air flow, and wherein the turbulence generators include individual bars set transversely to the combustion-air flow.

2. The burner as claimed in claim 1, wherein the turbulence generators form vortex trails on their rear sides in the direction of flow of the combustion-air flow, which vortex trails interact with the injection of the fuel.

3. The burner as claimed in claim 1, wherein the swirl generator includes at least two hollow, conical sectional bodies nested one inside the other in the direction of flow, wherein the respective longitudinal symmetry axes of the sectional bodies run mutually offset in such a way that adjacent walls of the sectional bodies form ducts, tangential in their longitudinal extent, for a combustion-air flow, and wherein at least one fuel nozzle can take effect in an interior space formed by the sectional bodies.

4. The burner as claimed in claim 3, wherein further fuel nozzles are arranged in a region of the tangential ducts in their longitudinal extent.

5. The burner as claimed in claim 3, wherein the sectional bodies have a blade-shaped profile in cross section.

6. The burner as claimed in claim 3, wherein the sectional bodies are nested spirally one inside the other.

7. The burner as claimed in claim 3, wherein the fuel nozzle is encased by a concentric ring, wherein the ring has a number of bores arranged in the peripheral direction, and wherein a fuel can be injected into an air quantity flowing through the bores.

8. The burner as claimed in claim 7, wherein the bores are directed so as to slant forward.

9. The burner as claimed in claim 7, wherein the fuel nozzle is surrounded by an annular air chamber.

10. The burner as claimed in claim 1, wherein the number of transition passages in the mixing section corresponds to the number of partial flows formed by the swirl generator.

11. The burner as claimed in claim 1, wherein the mixing tube arranged downstream of the transition passages is provided with openings in the direction of flow and in the peripheral direction for injecting an air flow into an interior of the mixing tube.

12. The burner as claimed in claim 11, wherein the openings run at an acute angle relative to a burner axis of the mixing tube.

13. The burner as claimed in claim 1, wherein a combustion space is arranged downstream of the mixing section, wherein there is a jump in cross section between the mixing section and the combustion space, which jump in cross section induces the initial cross section of flow of the combustion space, and wherein a backflow zone can take effect in a region of the jump in cross section.

14. The burner as claimed in claim 13 wherein said jump in cross section defines a stepped increase in cross section between the mixing section and the combustion space.

15. The burner as claimed in claim 1, wherein the mixing tube has a breakaway edge on a combustion-space side.

16. A burner for operating a heat generator, the burner comprising:

a swirl generator for a combustion-air flow and means for injecting at least one fuel into the combustion-air flow;

a mixing section arranged downstream of the swirl generator, said mixing section having, inside a first part of a section in the direction of flow, a number of transition passages for passing a flow formed in the swirl generator into a mixing tube arranged downstream of the transition passages;

wherein the combustion-air flow into the swirl generator flows against turbulence generators located upstream of the injection of the fuel into the combustion-air flow;

wherein the swirl generator includes at least two hollow, conical sectional bodies nested one inside the other in the direction of flow, the respective longitudinal symmetry axes of the sectional bodies being mutually offset such that adjacent walls of the sectional bodies form ducts, tangential in the longitudinal extent thereof, for a combustion-air flow, and wherein at least one fuel nozzle can take effect in an interior space formed by the sectional bodies, the fuel nozzle being encased by a concentric ring having a number of bores arranged in the peripheral direction, and wherein fuel can be injected into an air quantity flowing through the bores.

17. The burner as claimed in claim 16, wherein the bores are directed so as to slant forward.

18. The burner as claimed in claim 16, wherein the fuel nozzle is surrounded by an annular air chamber.

* * * * *